US009259894B2

(12) United States Patent
Abe et al.

(10) Patent No.: US 9,259,894 B2
(45) Date of Patent: Feb. 16, 2016

(54) SHEET PROCESSING APPARATUS AND IMAGE FORMING APPARATUS

(71) Applicant: CANON KABUSHIKI KAISHA, Tokyo (JP)

(72) Inventors: Hideto Abe, Toride (JP); Yusuke Obuchi, Nagareyama (JP); Yoshitaka Yamazaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/280,354

(22) Filed: May 16, 2014

(65) Prior Publication Data

US 2014/0339754 A1 Nov. 20, 2014

(30) Foreign Application Priority Data

May 20, 2013 (JP) ..... 2013-106002

(51) Int. Cl.

| | |
|---|---|
| ***B31F 5/02*** | (2006.01) |
| ***B65H 39/00*** | (2006.01) |
| ***B41F 17/00*** | (2006.01) |
| ***B42F 3/00*** | (2006.01) |
| ***B42B 5/00*** | (2006.01) |

(52) U.S. Cl.

CPC . *B31F 5/02* (2013.01); *B41F 17/00* (2013.01); *B42B 5/00* (2013.01); *B42F 3/003* (2013.01); *B65H 39/00* (2013.01); *B31F 2201/0712* (2013.01); *B31F 2201/0779* (2013.01); *B65H 2301/51616* (2013.01); *G03G 2215/00852* (2013.01)

(58) Field of Classification Search

CPC ..... B31F 5/02; B31F 2201/0712; B31F 2201/0779; B65H 2301/51616; B42F 3/003; G03G 2215/00852

USPC ..... 270/58.07, 58.08, 58.09

See application file for complete search history.

(56) References Cited

U.S. PATENT DOCUMENTS

| | | | | |
|---|---|---|---|---|
| 5,573,233 | A * | 11/1996 | Hirai et al. | 270/58.08 |
| 7,240,898 | B2 * | 7/2007 | Takamura et al. | 270/58.09 |
| 8,246,033 | B2 * | 8/2012 | Sato | 270/58.09 |
| 8,262,075 | B2 * | 9/2012 | Shiraishi | 270/58.09 |
| 2013/0045065 | A1 * | 2/2013 | Ito | 412/16 |
| 2013/0154178 | A1 * | 6/2013 | Suzuki et al. | 270/58.08 |
| 2013/0264762 | A1 * | 10/2013 | Matsushita et al. | 270/58.08 |

(Continued)

FOREIGN PATENT DOCUMENTS

| | | | |
|---|---|---|---|
| JP | 2010184769 | A * | 8/2010 |
| JP | 2010189101 | A | 9/2010 |

(Continued)

*Primary Examiner* — Leslie A Nicholson, III

(74) *Attorney, Agent, or Firm* — Canon USA Inc. IP Division

(57) ABSTRACT

A sheet processing apparatus includes: a binding unit that sandwiches and binds a plurality of sheets by using a convex portion and a concave portion; a moving unit that moves at least one of the convex portion and the concave portion; a drive unit that drives the moving unit; and a control unit that controls the drive unit so that a state in which the binding unit sandwiches the plurality of sheets at a predetermined pressing force by using a driving force from the drive unit is retained for a predetermined time period, and so that the one of the convex portion and the concave portion is moved in a direction away from the another of the convex portion and the concave portion after the predetermined time period has elapsed.

16 Claims, 10 Drawing Sheets

(56) References Cited

U.S. PATENT DOCUMENTS

| | | | | |
|---|---|---|---|---|
| 2013/0270762 | A1* | 10/2013 | Saito et al. | 270/58.08 |
| 2013/0300050 | A1* | 11/2013 | Suzuki et al. | 270/58.07 |
| 2014/0219747 | A1* | 8/2014 | Takahashi et al. | 412/6 |

FOREIGN PATENT DOCUMENTS

| | | | |
|---|---|---|---|
| JP | 2010208854 | A * | 9/2010 |
| JP | 2010274623 | A * | 12/2010 |
| JP | 2011201698 | A * | 10/2011 |

* cited by examiner

SHEET PROCESSING APPARATUS AND IMAGE FORMING APPARATUS

BACKGROUND OF THE INVENTION

1. Field of the Invention

The present invention relates to a sheet processing apparatus and an image forming apparatus, and particularly to a unit configured to bind sheets.

2. Description of the Related Art

Hitherto, some image forming apparatuses, such as a copying machine, a laser beam printer, a facsimile machine, and a multifunction device having functions of these machines, have included a sheet processing apparatus that performs a process of, for example, binding sheets on which an image has been formed. Significant emphasis is placed on recyclability in consideration of the environment and the like, and a sheet processing apparatus has been suggested in which sheets are bound without using staples. As such a sheet processing apparatus, for example, a sheet processing apparatus is provided in which a sheet binding unit including inverted V-shaped upper teeth and V-shaped lower teeth performs a binding process on a sheet bundle.

In the sheet processing apparatus, sheets are put together and aligned, and then the sheets are pressed by meshing the lower teeth and the upper teeth so as to form, on part of a sheet bundle, projections and depressions in a thickness direction, thereby entangling fibers of superimposed sheets in the sheet bundle with each other so as to bind the sheet bundle. Hereinafter, such a binding method for binding a bundle of fibrous sheets without using staples is called stapleless binding.

Hitherto, there has been provided a sheet processing apparatus in which a cam is used as a component configured to mesh lower teeth and upper teeth (see Japanese Patent Laid-Open No. 2010-189101). In a sheet binding unit of this sheet processing apparatus, as illustrated in FIG. 10A, a cam 116 having cam surfaces 116*a*, 116*b*, and 116*c* that are different in length in a radial direction with respect to a rotating shaft 117 is used.

When stapleless binding is performed, the cam 116 is rotated, and upper teeth 112 disposed in an upper supporting base 110 are pressed against lower teeth 111 disposed in a lower supporting base 119 via an elastic member 115.

The cam 116 is provided with a plurality of cam surfaces 116*a*, 116*b*, and 116*c* so that a pressing force corresponding to the thickness of a sheet to be bound or the number of sheets to be bound is obtained. When configuration is made so that the upper teeth 112 are pressed via the elastic member 115, even in the case of a sheet bundle S having an intermediate thickness that is not able to be dealt with by the cam surface 116*a*, 116*b*, or 116*c*, a pressing force corresponding to the sheet bundle S may be obtained owing to deformation of the elastic member 115.

In the configuration illustrated in FIGS. 10A and 10B, in order to withstand a large force applied to the elastic member 115 when the upper teeth 112 are pressed against the lower teeth 111, an elastic member having a high spring constant is required, thereby resulting in an increase in cost.

SUMMARY OF THE INVENTION

The present invention provides a sheet processing apparatus and an image forming apparatus that secure a pressing force applied to a sheet bundle with more certainty and enable the sheet bundle to be bound with certainty.

A sheet processing apparatus of the present invention includes: a binding unit that includes a convex portion and a concave portion, and sandwiches and binds a plurality of sheets by using the convex portion and the concave portion, a moving unit that moves at least one of the convex portion and the concave portion with respect to another of the convex portion and the concave portion, a drive unit that drives the moving unit, and a control unit that controls the drive unit so that a state in which the binding unit sandwiches the plurality of sheets at a predetermined pressing force by using a driving force from the drive unit is retained for a predetermined time period, and so that the one of the convex portion and the concave portion is moved in a direction away from the another of the convex portion and the concave portion after the predetermined time period has elapsed.

Further features of the present invention will become apparent from the following description of exemplary embodiments with reference to the attached drawings.

DESCRIPTION OF THE EMBODIMENTS

Figure 1:
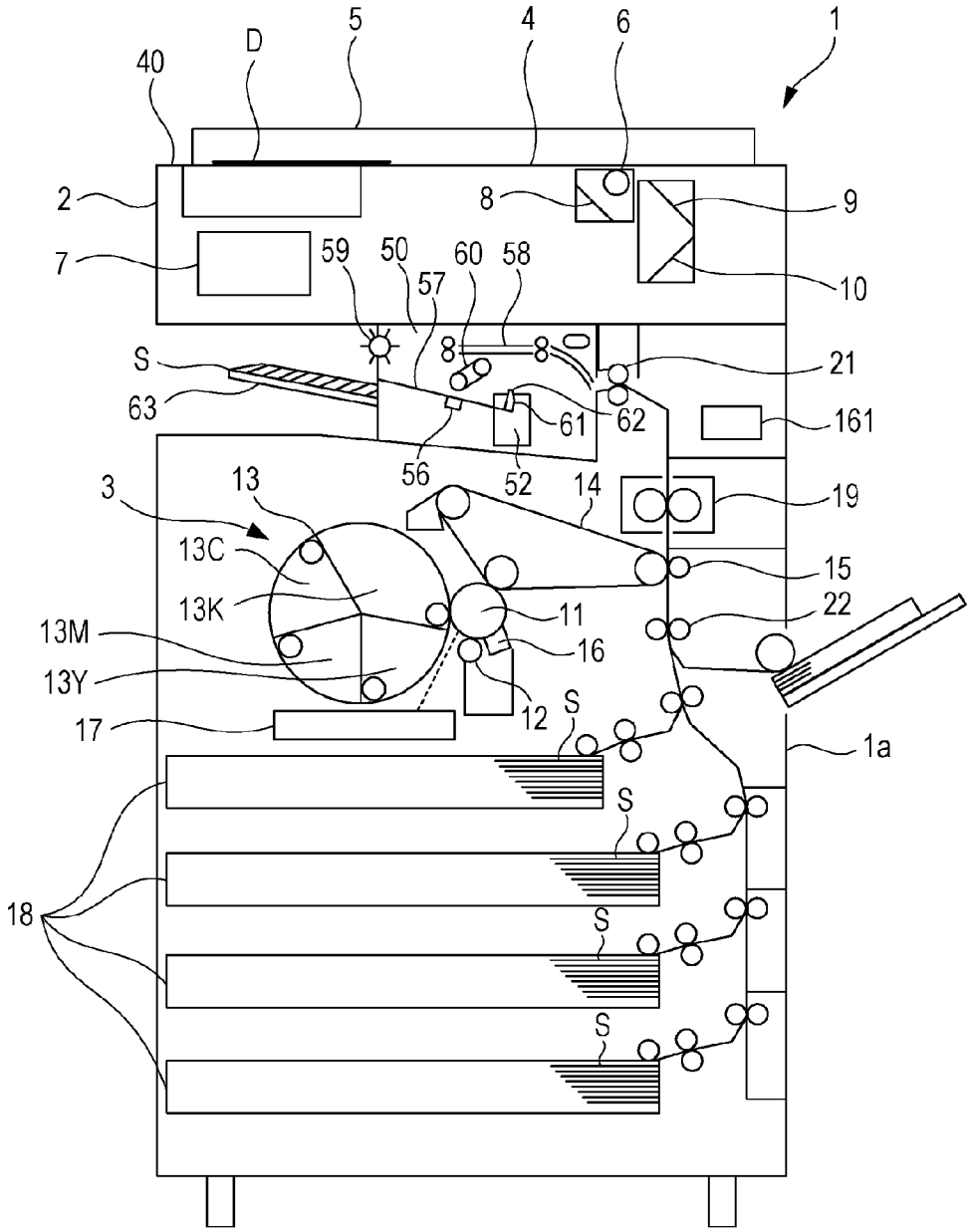
FIG. 1 illustrates the configuration of an image forming apparatus including a sheet processing apparatus according to an embodiment of the present invention.

An embodiment for implementing the present invention will be described in detail below with reference to the drawings. FIG. 1 illustrates the configuration of an image forming apparatus including a sheet processing apparatus according to the embodiment of the present invention. In FIG. 1, a reference numeral 1 denotes an image forming apparatus, a reference numeral 1*a* denotes an image forming apparatus main body (hereinafter referred to as an apparatus main body), a reference numeral 2 denotes an image reading unit provided on the top of the apparatus main body 1*a*, and a reference numeral 3 denotes an image forming unit provided within the apparatus main body 1*a*.

Here, a platen 4 composed of a transparent glass plate is fixed to the top of the image reading unit 2. On the underside of the platen 4, there are provided a lamp 6 that illuminates a document D, and an optical system composed of reflection mirrors 8, 9, and 10 for guiding a light image of the illuminated document D to an image processing unit 7. A document D is placed on the platen 4 in a state that an image surface of the document D faces down. When the image reading unit 2 reads a document image of the document D on the platen 4, the document D that has been pressed and fixed by a document pressing plate 5 is scanned by moving the lamp 6 and the reflection mirrors 8, 9, and 10 at a predetermined speed.

The image forming unit 3 includes a photosensitive drum 11, a charging roller 12, a rotary development unit 13, an intermediate transfer belt 14, a secondary transfer roller 15, a cleaner 16, and so forth. A laser unit 17 emits a light image to the photosensitive drum 11 on the basis of image data, and an electrostatic latent image is formed on the surface of the photosensitive drum 11. The charging roller 12 charges the surface of the photosensitive drum 11 uniformly before a laser beam is emitted.

The rotary development unit 13 causes magenta (M) toner, cyan (C) toner, yellow (Y) toner, and black (K) toner to adhere to the electrostatic latent image formed on the surface of the photosensitive drum 11 so as to form a toner image. In the embodiment, the rotary development unit 13 is of a rotary development type and includes development devices 13K, 13Y, 13M, and 13C, and is rotated by a motor, which is not illustrated.

When a black-and-white toner image is formed on the photosensitive drum 11, the development device 13K is rotationally moved to a development position in close proximity to the photosensitive drum 11, and development is performed. When a full-color toner image is formed, the rotary development unit 13 is rotated, the development devices 13K, 13Y, 13M, and 13C are positioned at the development position, and thus development is performed for each color sequentially.

Primary transfer of the toner image developed on the surface of the photosensitive drum 11 is performed onto the intermediate transfer belt 14, and the secondary transfer roller 15 transfers the toner image on the intermediate transfer belt 14 onto a sheet S. The cleaner 16 removes toner remaining on the photosensitive drum 11 after the toner image has been transferred. A sheet processing apparatus 50 is connected between the apparatus main body 1*a* and the image reading unit 2. A reference numeral 161 denotes an apparatus main body central processing unit (CPU) serving as a control unit that controls the apparatus main body 1*a*, and a reference numeral 40 denotes an operation unit.

In the image forming apparatus 1, when an image of the document D is formed on a sheet, first, the document D placed on the platen 4 is scanned by moving the lamp 6 and the reflection mirrors 8, 9, and 10 at a predetermined speed, and read image data is guided to the image processing unit 7. Subsequently, the read image data is input to the laser unit 17, and the laser unit 17 emits light based on this image data to the photosensitive drum 11 of the image forming unit 3. In this way, when a laser beam is emitted, an electrostatic latent image is formed on a photosensitive drum surface, this electrostatic latent image is developed by the rotary development unit 13, and a toner image is thereby formed on the photosensitive drum surface. Then, primary transfer of this toner image is performed onto the intermediate transfer belt 14.

On the other hand, after a sheet S has been appropriately and selectively fed from sheet feed cassettes 18, skew feeding is corrected by a pre-registration roller pair 22 which is stationary. After that, the sheet S is sent to a secondary transfer unit constituted by the secondary transfer roller 15 and the intermediate transfer belt 14 by the pre-registration roller pair 22 which starts to rotate at a predetermined point in time. Then, in the secondary transfer unit, the toner image which has been formed on the photosensitive drum 11 and then transferred onto the intermediate transfer belt 14 is transferred onto the sheet S. Subsequently, the sheet S is guided to a fixing unit 19, and subjected to a process of applying heat and pressure in the fixing unit 19, so that the transferred toner image is permanently fixed. The sheet S on which the toner image has been permanently fixed is then conveyed outside the apparatus main body 1*a* by a main body ejection roller pair 21 and is guided to the sheet processing apparatus 50.

Here, the sheet processing apparatus 50 includes a processing tray 57 serving as a sheet stacking unit that is inclined downward on the upstream side in a sheet conveyance direction, a stack tray 63 disposed on the downstream side in the sheet conveyance direction with respect to the processing tray 57, and a stapleless binding device 52 serving as a binding unit that performs stapleless binding. This stapleless binding device 52 performs stapleless binding by sandwiching, by using inverted V-shaped teeth (convex portion) and V-shaped teeth (concave portion), part of a bundle of a plurality of sheets S which have been conveyed from the image forming apparatus 1, put together, and aligned, so as to entangle fibers of sheets in the sheet bundle with each other.

When the sheet S on which an image has been formed is ejected from the apparatus main body 1*a*, the sheet S is conveyed toward the stack tray 63 through a conveying unit 58. At a point in time when a rear end of the sheet S passes through the conveying unit 58, a paddle 59 rotates in a direction opposite to the sheet conveyance direction. The sheet S is thereby drawn into the processing tray 57, and further struck to a rear end alignment plate 62 by a return roller 60, and thus the rear end of the sheet S is aligned. In the processing tray 57, there is provided a sheet detection sensor 56 that detects the presence or absence of a sheet S on the processing tray 57.

Figure 2:
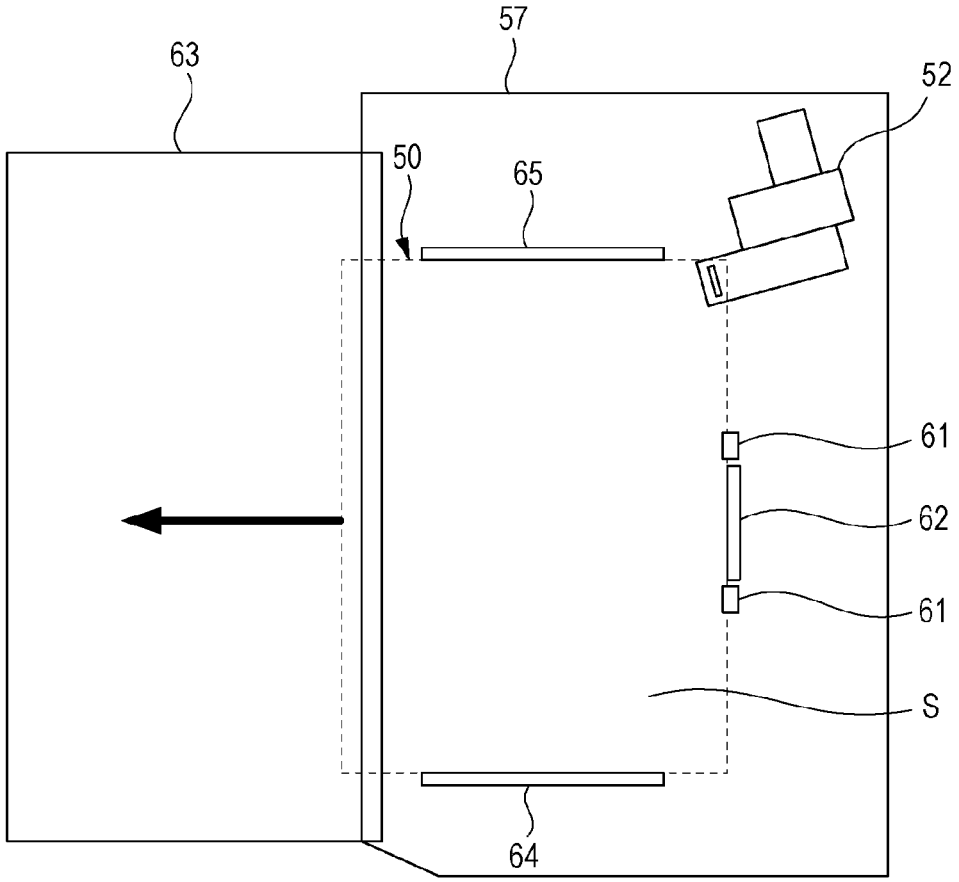
FIG. 2 illustrates the configuration of the sheet processing apparatus.

The sheet S whose rear end has been aligned within the processing tray 57 is aligned in terms of a position in a width direction perpendicular to the sheet conveyance direction by front and back alignment plates 64 and 65 illustrated in FIG. 2, and is stacked on the processing tray 57. After a series of these operations has been repeatedly performed and a JOB-designated number of sheets have been stacked on the processing tray 57, in the case where a user has designated a stapleless binding process in JOB settings in advance, a binding process is performed at a position illustrated in FIG. 2 by the stapleless binding device 52. Subsequently, sheets S on which the binding process has been completed are ejected onto the stack tray 63 by a bundle ejection member 61 that moves in an arrow direction.

Figure 3A:
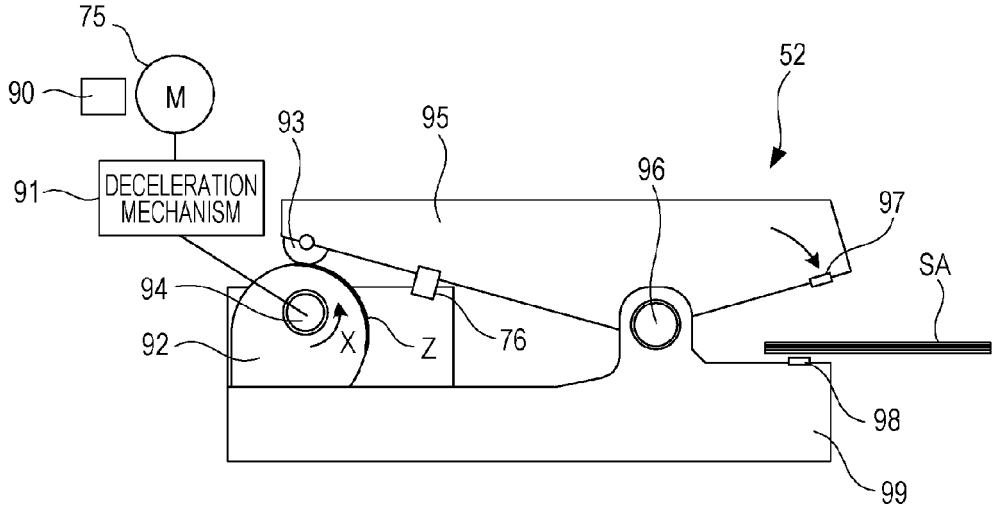
FIGS. 3A and 3B each illustrate a stapleless binding device provided in the sheet processing apparatus.
Figure 3B:
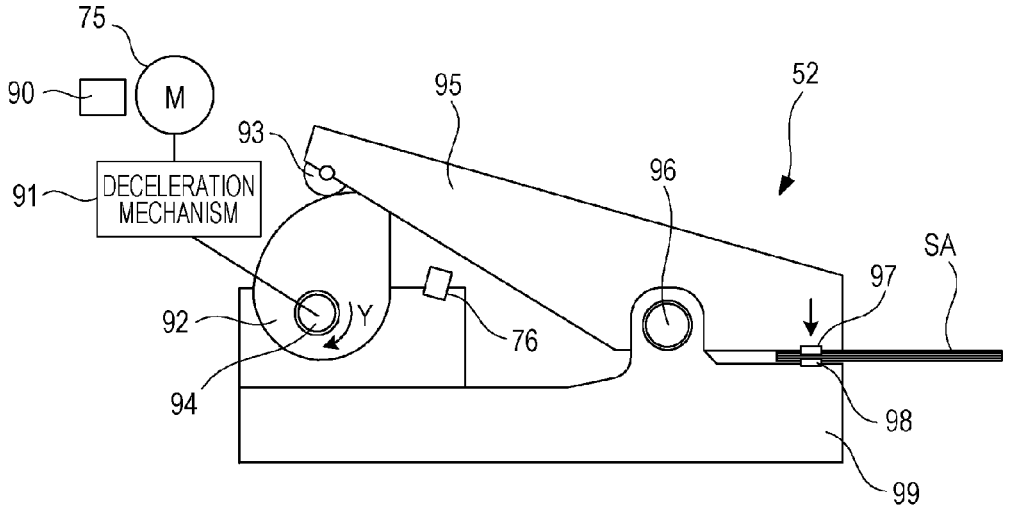

Next, the stapleless binding device 52 according to the embodiment will be described with reference to FIGS. 3A and 3B. FIG. 3A illustrates the stapleless binding device 52 which is in a waiting state, and FIG. 3B illustrates the stapleless binding device 52 which is in a binding operation state. The stapleless binding device 52 includes an upper arm 95 in which upper teeth 97, which are inverted V-shaped teeth, are installed, and a lower arm 99 in which lower teeth 98, which are V-shaped teeth, are installed. The lower arm 99 is fixed to a housing frame of the sheet processing apparatus 50. In FIGS. 3A and 3B, a reference numeral 76 denotes a stapleless binding reference sensor which detects that the upper arm 95 is located at a reference position illustrated in FIG. 3A.

The upper arm 95 is swung around an arm shaft 96, and also urged counterclockwise by an urging unit, which is not illustrated. A roller 93 is provided at an end on the side opposite to the end of the upper arm 95 at which the upper teeth 97 are installed, and a cam 92 that rotates around a camshaft 94 is pressed against the roller 93 from below.

The cam 92 swings the upper arm 95 and moves the upper teeth 97, which are one-side teeth, so as to mesh the upper teeth 97 with the lower teeth 98, which are the other-side teeth. The cam 92 serving as a moving unit is fixed to the camshaft 94 that is rotated by a deceleration mechanism 91 composed of a stapleless binding motor 75 capable of normally rotating and reversely rotating and a gear connected to the stapleless binding motor 75.

In the embodiment, as the stapleless binding motor 75, a DC brush motor in which torque of a motor output shaft is proportionate to a value of a current flowing through the motor is used. When the DC brush motor is employed, the torque of the output shaft is controlled by changing the current value, so that a predetermined pressing force may be generated. In addition, a stapleless binding encoder sensor 90 for measuring a rotational speed of the stapleless binding motor 75 is provided in the output shaft of the stapleless binding motor 75. The stapleless binding encoder sensor 90 is an optical sensor, and detects slits provided in a disk, which is not illustrated, mounted on the output shaft of the stapleless binding motor 75 and outputs a pulse signal whose period varies in accordance with a motor rotational speed. As for the disk according to the embodiment, the number of slits is 18 per cycle.

Figure 4:
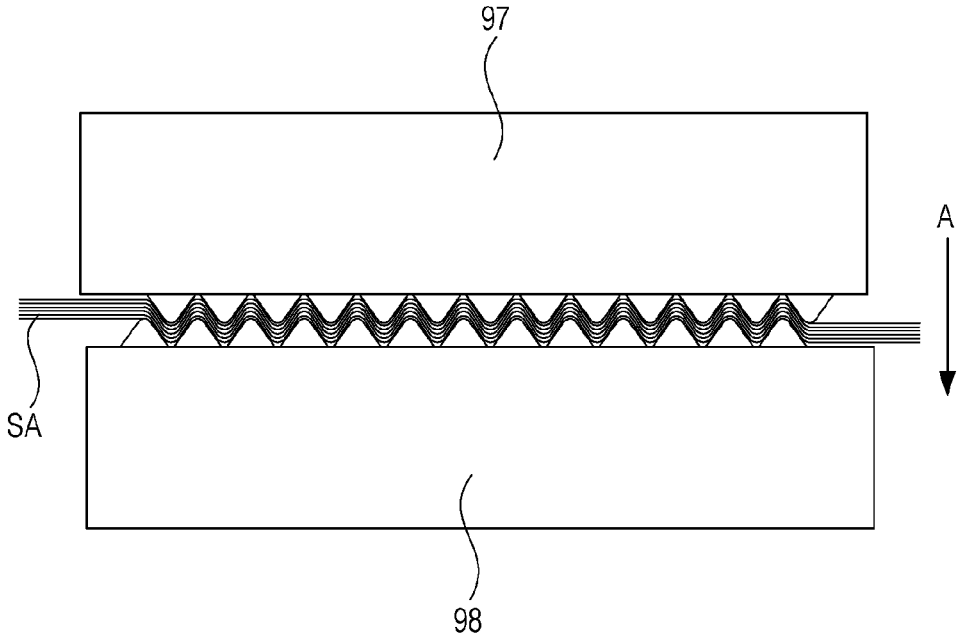
FIG. 4 is a cross-sectional view illustrating a state of sheets on which stapleless binding has been performed by the stapleless binding device.

When the cam 92 rotates in an arrow X direction, as illustrated in FIG. 3B, the upper arm 95 is swung clockwise, the lower teeth 98 installed in the lower arm 99 and the upper teeth 97 mesh with each other with a sheet bundle SA interposed therebetween, and the sheet bundle SA is pressed. Here, when the sheet bundle SA is pressed, fibers of superimposed sheets in the pressed sheet bundle SA are stretched and surface fibers are thereby exposed. Then, the sheet bundle SA is further pressed, the fibers of the sheets are thereby entangled with each other, and thus the sheet bundle SA is bound. FIG. 4 illustrates a sheet bundle SA pressed by the upper teeth 97 and the lower teeth 98. In the embodiment, the lower teeth 98 are fixed, and stapleless binding is performed on five sheets S by applying a load from the upper teeth 97 to the lower teeth 98 in an arrow A direction.

In the embodiment, while sheets are being stacked on the processing tray 57, the position of the upper arm 95 is controlled by using the stapleless binding reference sensor 76 so that the cam 92 is located at bottom dead center as illustrated in FIG. 3A. Thus, when the cam 92 is located at the bottom dead center, a space is generated between the upper teeth 97 and the lower teeth 98, thereby enabling sheets to enter.

At this time, a predetermined edge line region from the bottom dead center of the cam 92 to a thick line Z portion illustrated in FIG. 3A has a substantially constant radius with respect to the camshaft 94 and has a cam shape causing a significantly small load. Thus, in an initial state in which the cam 92 starts to rotate from the bottom dead center, the stapleless binding motor 75 is put into a substantially no-load state. In the outer periphery of the cam 92, a portion on the side opposite to the X direction with respect to the thick line Z portion is a portion in which a distance from the center of the cam 92 increases gradually.

When a binding operation is performed, the cam 92 rotates around the camshaft 94 in the X direction by driving of the stapleless binding motor 75, the upper arm 95 is thereby swung around the arm shaft 96 clockwise as illustrated in FIG. 3B, and the upper teeth 97 and the lower teeth 98 mesh with each other. At this time, the upper teeth 97 and the lower teeth 98 mesh with each other at a predetermined pressure by adjusting a driving current of the stapleless binding motor 75 so as to control a rotation amount of the cam 92 as described later. After the sheet bundle SA has been bound by meshing the upper teeth 97 and the lower teeth 98 at the predetermined pressure, the stapleless binding motor 75 reversely rotates so as to cause the cam 92 to rotate around the camshaft 94 in a Y direction. Then, when the cam 92 reaches the bottom dead center again, the stapleless binding reference sensor 76 detects the upper arm 95, and rotation of the stapleless binding motor 75 is stopped.

Figure 5:
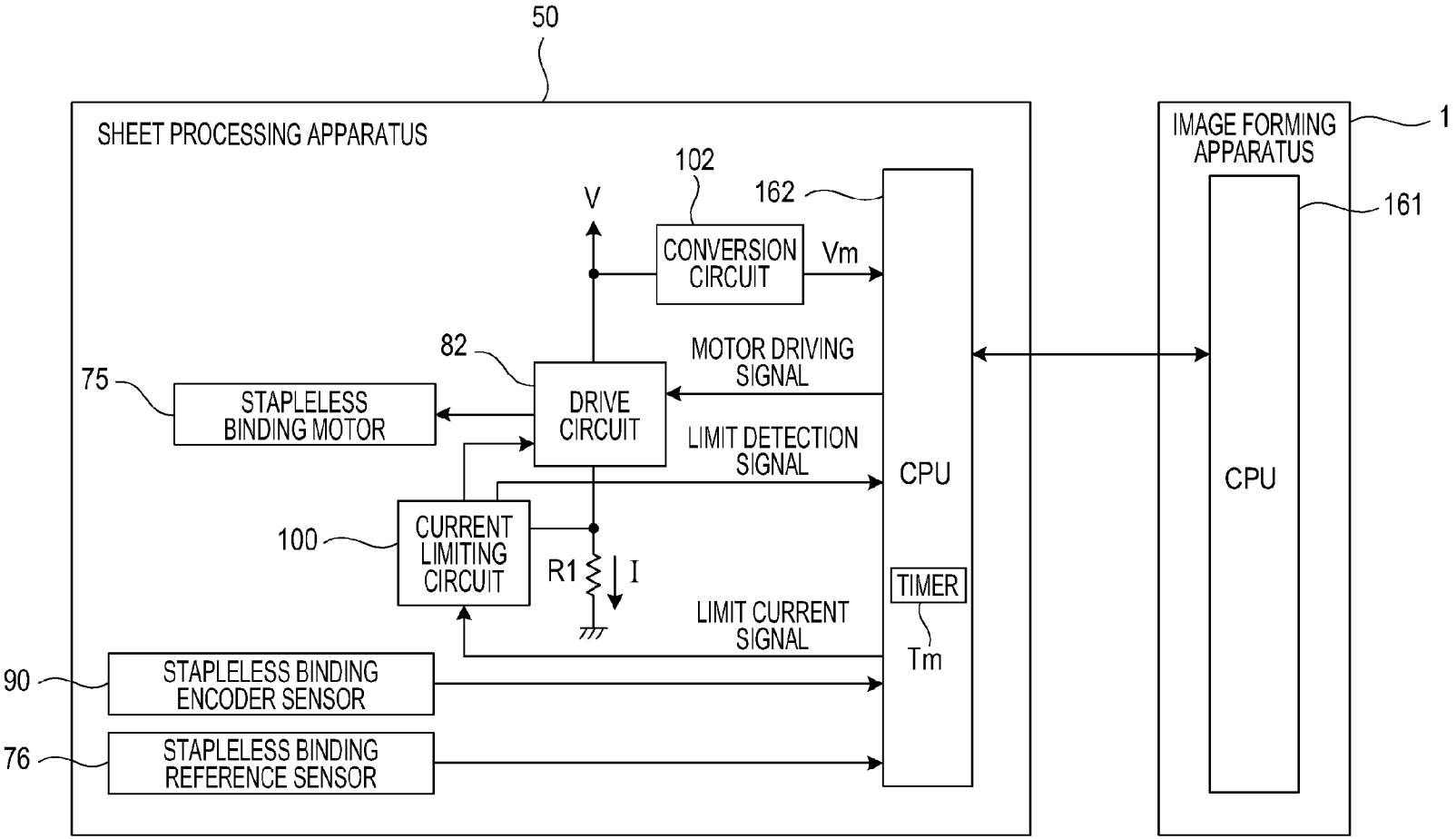
FIG. 5 is a control block diagram of the image forming apparatus and the sheet processing apparatus.

FIG. 5 is a control block diagram of the image forming apparatus 1 and the sheet processing apparatus 50. In FIG. 5, a reference numeral 162 denotes a sheet processing apparatus CPU that controls the sheet processing apparatus 50. This sheet processing apparatus CPU 162 (hereinafter referred to as a CPU 162) is capable of detecting states of both the apparatuses by communicating with the apparatus main body CPU 161. When an image forming operation and a sheet processing operation are performed, the user sets JOB settings in the apparatus main body CPU 161 via the operation unit 40 or an external personal computer (PC), which is not illustrated, through a network. The apparatus main body CPU 161 forms an image on the basis of image data input from the image reading unit 2 in the case of a copy operation, or on the basis of image data transmitted from a PC via a network in the case of a printing operation. In the case of sheet processing, the CPU 162 performs sheet processing.

The stapleless binding motor 75, the stapleless binding encoder sensor 90, and the stapleless binding reference sensor 76 are connected to the CPU 162. The stapleless binding reference sensor 76 detects that the upper arm 95 is located at a position at which the upper arm 95 receives sheets as illustrated in FIG. 3A already described, and notifies the CPU 162 of the position as a reference position. Subsequently, the CPU 162 detects the position of the upper arm 95 by using the stapleless binding reference sensor 76, drives the stapleless binding motor 75 via a drive circuit 82, and also keeps a driving force (driving torque) generated, and thereby performs a binding process. The CPU 162 is equipped with a timer Tm that measures a predetermined time period to be described.

In FIG. 5, a reference numeral 82 denotes the drive circuit serving as an adjustment unit that adjusts the magnitude of the amount of a current to be sent to the stapleless binding motor 75 from a power source in accordance with the magnitude of a driving torque to be generated by the stapleless binding motor 75 in order to sandwich a plurality of sheets at a predetermined pressing force. A driving voltage V used as power for driving the stapleless binding motor 75 is input to this drive circuit 82. The driving voltage V is converted in terms of a voltage level by a conversion circuit 102, and then is input to the CPU 162 as Vm. The CPU 162 detects a driving voltage level by using this Vm. R1 denotes a shunt resistor serving as a detection unit that detects the magnitude of a driving current I flowing through the stapleless binding motor 75. This shunt resistor R1 is arranged in parallel with an ammeter and inserted between the drive circuit 82 and a ground.

A reference numeral 100 denotes a current limiting circuit. This current limiting circuit 100 compares a limit current signal from the CPU 162 with a current signal that is generated in the shunt resistor R1 and corresponds to the driving current I of the stapleless binding motor 75. The current limiting circuit 100 controls the drive circuit 82 so that the driving current I of the stapleless binding motor 75 does not exceed a limit current predetermined in the CPU 162. The current limiting circuit 100 also outputs a limit detection signal to the CPU 162 at a point in time when the driving current I of the stapleless binding motor 75 reaches a predetermined value represented by the limit current signal.

Figure 6:
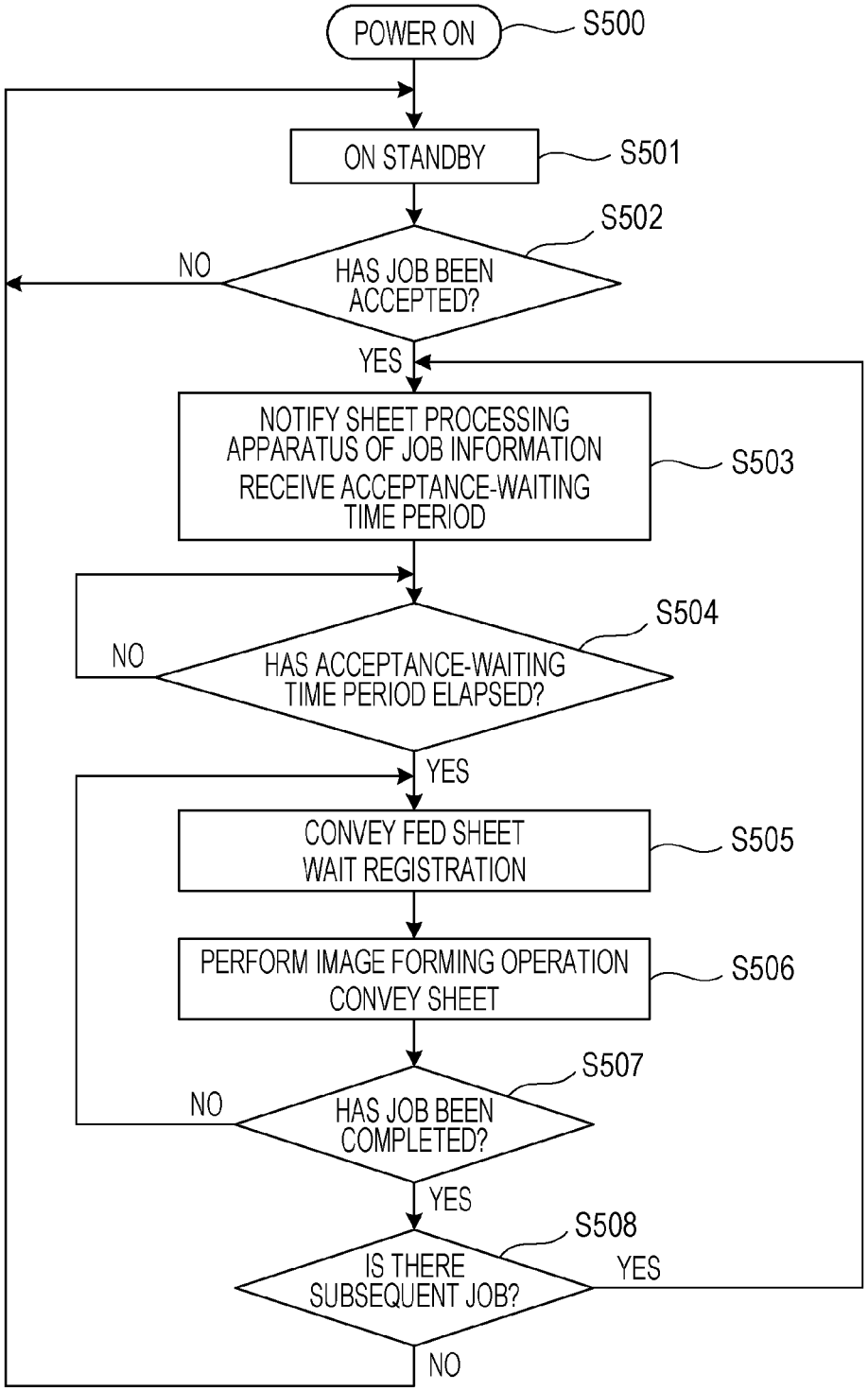
FIG. 6 is a flowchart illustrating a control operation performed by an image forming apparatus main body CPU.

Next, a control operation performed by the apparatus main body CPU 161 according to the embodiment will be described with reference to a flowchart illustrated in FIG. 6.

When a power source of the image forming apparatus 1 is turned ON (S500), the apparatus main body CPU 161 is activated, performs an initial operation, and then is put into a standby state (S501). Then, the apparatus main body CPU 161 remains in the standby state until the image forming apparatus 1 accepts a JOB set by the user via the operation unit 40 or an external PC, which is not illustrated, through a network. Subsequently, when a JOB is accepted (YES in S502), in the case where the JOB is a JOB which is to be performed by using the sheet processing apparatus 50, a notification of JOB information is provided to the CPU 162 via a signal line. Here, the CPU 162 which has received the JOB information provides a notification of an acceptance-waiting time period based on the JOB information, which will be described later.

In this way, after the notification of the JOB information has been provided to the CPU 162, when the acceptance-waiting time period is received (S503), the apparatus main body CPU 161 waits until this acceptance-waiting time period elapses (S504). Then, when the acceptance-waiting time period elapses (YES in S504), that is, when the sheet processing apparatus 50 is put into a state of being able to accept sheets, a sheet S is fed and conveyed from a sheet feed cassette 18, and then is caused to wait (wait registration) at a registration position provided by the pre-registration roller pair 22 (S505). Subsequently, an image forming operation is performed, and the sheet S is conveyed from the registration position by driving the pre-registration roller pair 22 in synchronization with an image formation timing (S506).

Thus, the sheet S is conveyed to the secondary transfer unit, a toner image on the intermediate transfer belt 14 is transferred onto the sheet S in the secondary transfer unit, this toner image is fixed by the fixing unit 19, and then the sheet S is ejected to the sheet processing apparatus 50. After that, the apparatus main body CPU 161 determines whether an image forming JOB has been completed on a predetermined number of sheets in accordance with the JOB information (S507). When the JOB has not been completed (NO in S507), the process returns to S505, and when the JOB has been completed (YES in S507), it is determined whether or not there is a subsequent JOB (S508). Then, when there is a subsequent JOB (YES in S508), the process returns to S503, and when there is no subsequent JOB (NO in S508), the process returns to the standby state in S501 and the apparatus main body CPU 161 remains on standby until acceptance of a JOB (S502).

Figure 7:
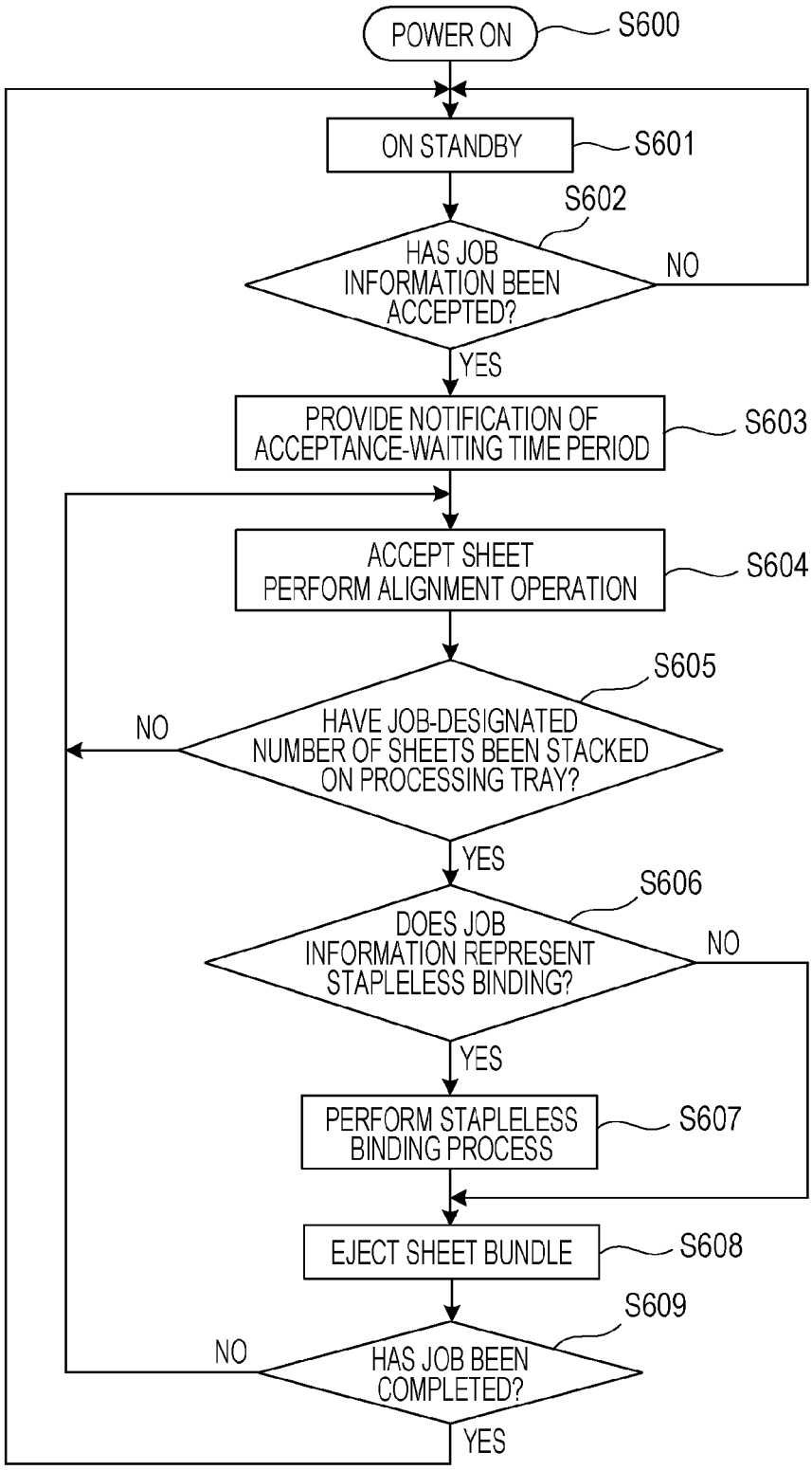
FIG. 7 is a flowchart illustrating a control operation performed by a sheet processing apparatus CPU.

Next, a control operation performed by the CPU 162 according to the embodiment will be described with reference to a flowchart illustrated in FIG. 7. When the power source of the image forming apparatus 1 is turned ON as already described, power is also supplied from the image forming apparatus 1 to the sheet processing apparatus 50, and a power source of the sheet processing apparatus 50 is turned ON (S600). The CPU 162 is thereby activated, performs an initial operation for the sheet processing apparatus 50, and then is put into a standby state (S601).

The CPU 162 remains in the standby state until a notification of JOB information is provided from the apparatus main body CPU 161. Subsequently, when the CPU 162 accepts JOB information (YES in S602), the CPU 162 notifies the apparatus main body CPU 161 of a predetermined acceptance-waiting time period taken for the sheet processing apparatus 50 to be put into a state of being able to accept sheets from the image forming apparatus 1 on the basis of the JOB information (S603).

Then, when the sheet processing apparatus 50 receives a sheet S, after the sheet S is conveyed at an accelerating rate by the conveying unit 58, the CPU 162 drives and rotates the paddle 59 so as to draw the sheet S into the processing tray 57. Furthermore, the sheet S is conveyed such that it is struck to the rear end alignment plate 62 by the return roller 60, and thus a rear end of the sheet S is aligned. Subsequently, the sheet S is aligned in a sheet width direction by the front and back alignment plates 64 and 65 (S604), and is stacked on the processing tray 57.

Then, the CPU 162 determines whether or not a JOB-designated number of sheets have been stacked on the processing tray 57 (S605). When the JOB-designated number of sheets have not been stacked (NO in S605), the process returns to S604, and when the JOB-designated number of sheets have been stacked (YES in S605), it is determined whether or not the JOB information represents stapleless binding (S606). When the JOB information represents stapleless binding (YES in S606), the CPU 162 performs a stapleless binding process to be described (S607).

Then, when the stapleless binding process is completed, or when the JOB information does not represent stapleless binding (NO in S606), a rear end side of a sheet bundle stacked on the processing tray 57 is pushed by the bundle ejection member 61 and is ejected to the stack tray 63 (S608). Subsequently, the CPU 162 determines whether or not a JOB has been completed in accordance with the JOB information (S609). When the JOB has not been completed (NO in S609), the process returns to S604, and when the JOB has been completed (YES in S609), the process returns to the standby state in S601 and the CPU 162 remains on standby until acceptance of JOB information (S602).

Figure 8:
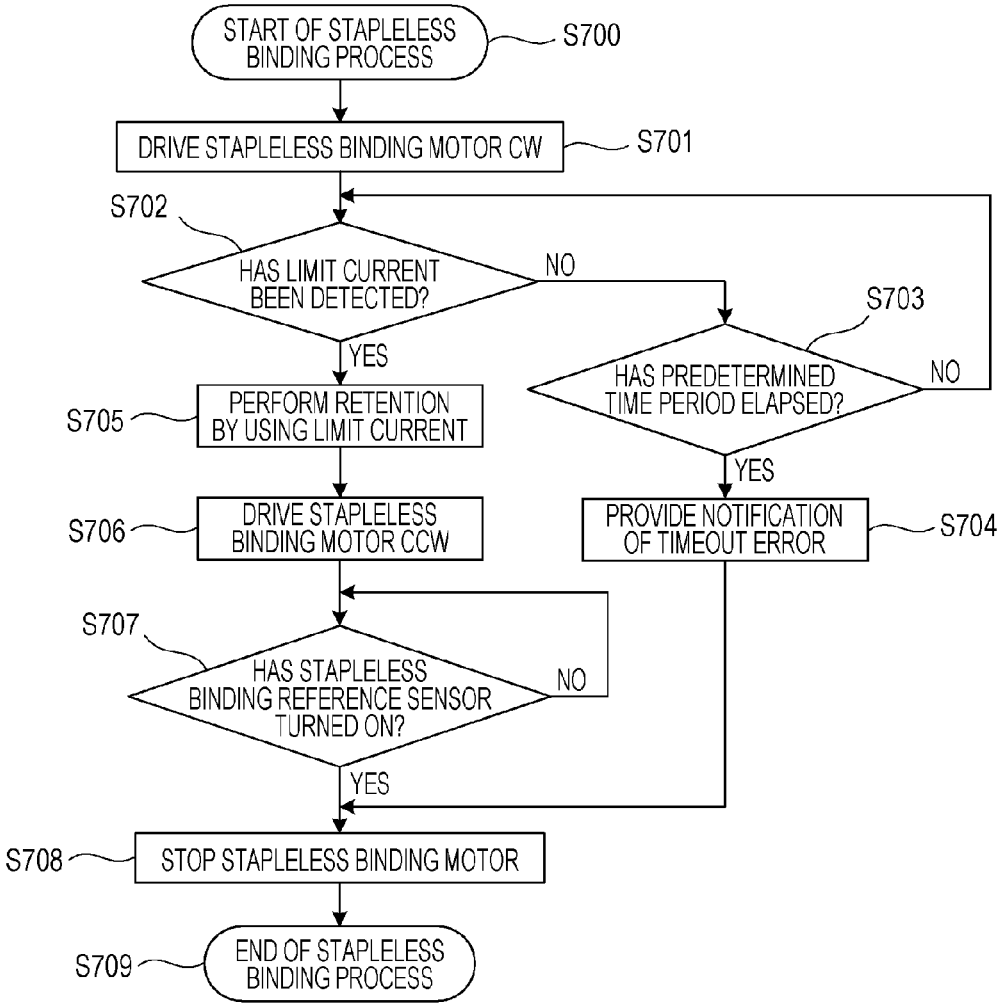
FIG. 8 is a flowchart illustrating a stapleless binding process control operation performed by the sheet processing apparatus CPU.

Next, stapleless binding process control performed by the CPU 162 will be described with reference to a flowchart illustrated in FIG. 8. In the case where the stapleless binding process in S607 in FIG. 7 already described has been set in JOB information, the CPU 162 starts the stapleless binding process (S700). In other words, the CPU 162 drives and rotates the stapleless binding motor 75 normally, that is, drives the stapleless binding motor 75 in a clockwise (CW) direction (S701). When the CPU 162 drives the stapleless binding motor 75 in the CW direction, the cam 92 is driven to rotate in the arrow X direction from the bottom dead center as illustrated in FIG. 3A already described. At this time, the CPU 162 sets a limit current value to control the drive circuit 82 so that the driving current I of the stapleless binding motor 75 becomes less than or equal to a predetermined current value.

Subsequently, when the cam 92 continues to rotate, because the upper arm 95 is swung clockwise, the load on the stapleless binding motor 75 increases. Then, when the stapleless binding encoder sensor 90 detects a decrease in the rotational speed of the stapleless binding motor 75 with the increase in load, the CPU 162 increases the driving current I. After a while, when a sheet bundle is sandwiched by the upper teeth 97 and the lower teeth 98 and the process reaches a binding operation point illustrated in FIG. 9, the driving current I of the stapleless binding motor 75 reaches the limit current value, which is a current of a predetermined magnitude. In this way, when the driving current I of the stapleless binding motor 75 reaches the limit current value, which is a current of a predetermined magnitude, the current limiting circuit 100 outputs a limit detection signal to the CPU 162.

For example, when the stapleless binding motor 75 is not driven in a normal way, no limit current is detected. Then, when a predetermined time period has elapsed (YES in S703) since the stapleless binding motor 75 was driven without any limit current being detected (NO in S702), the CPU 162 notifies the apparatus main body CPU 161 of a timeout error (S704). Subsequently, the CPU 162 stops the stapleless binding motor 75 (S708), and ends the stapleless binding process (S709).

Figure 9:
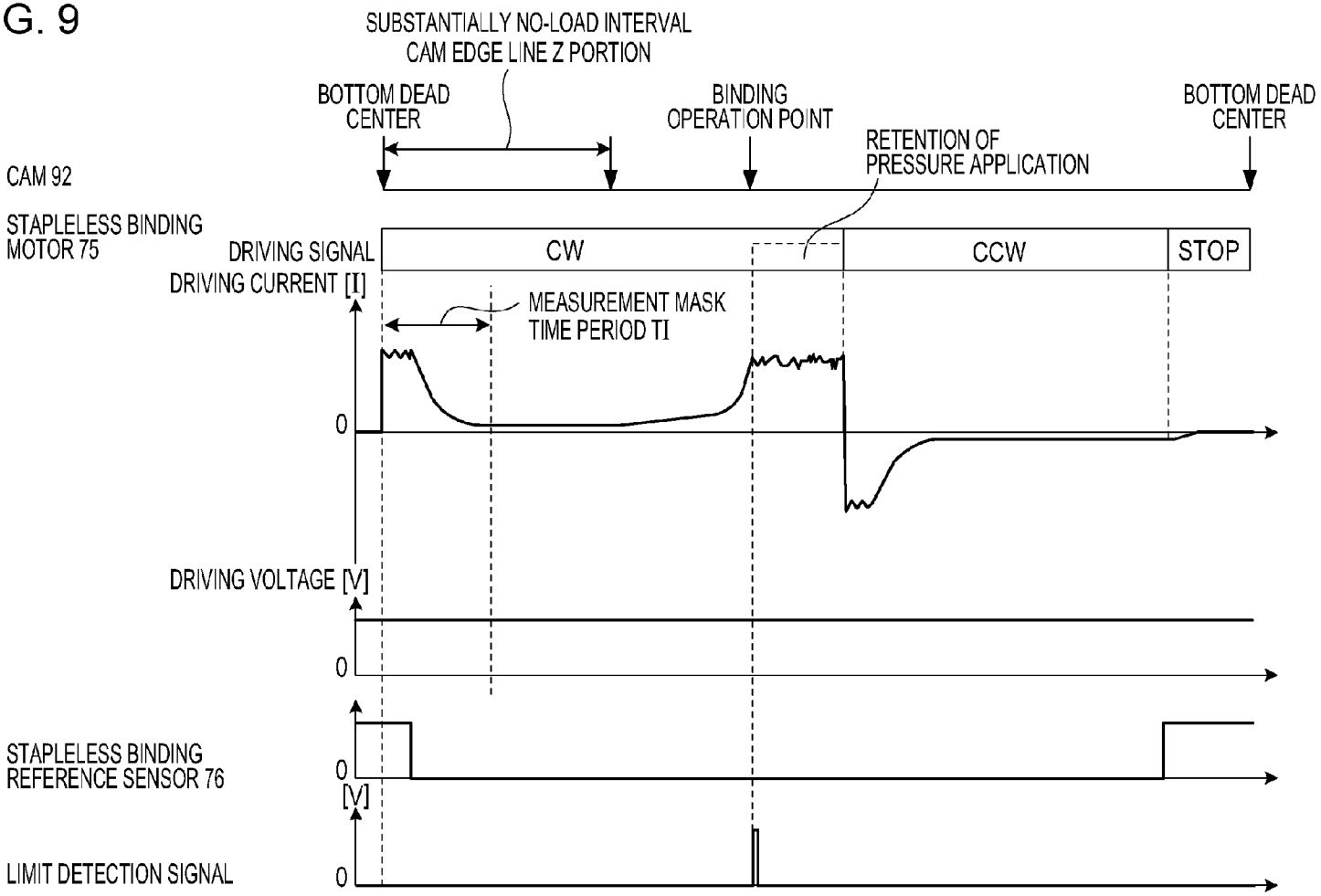
FIG. 9 illustrates an operation sequence performed when a stapleless binding process according to the embodiment of the present invention is performed.
Figure 10A:
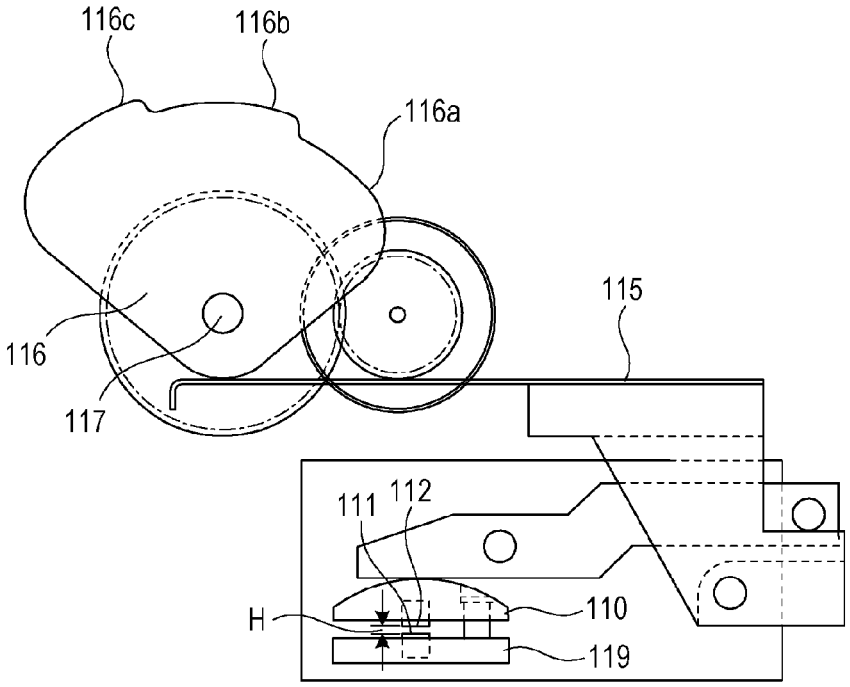
FIGS. 10A and 10B each illustrate a sheet binding unit provided in an existing sheet processing apparatus.
Figure 10B:
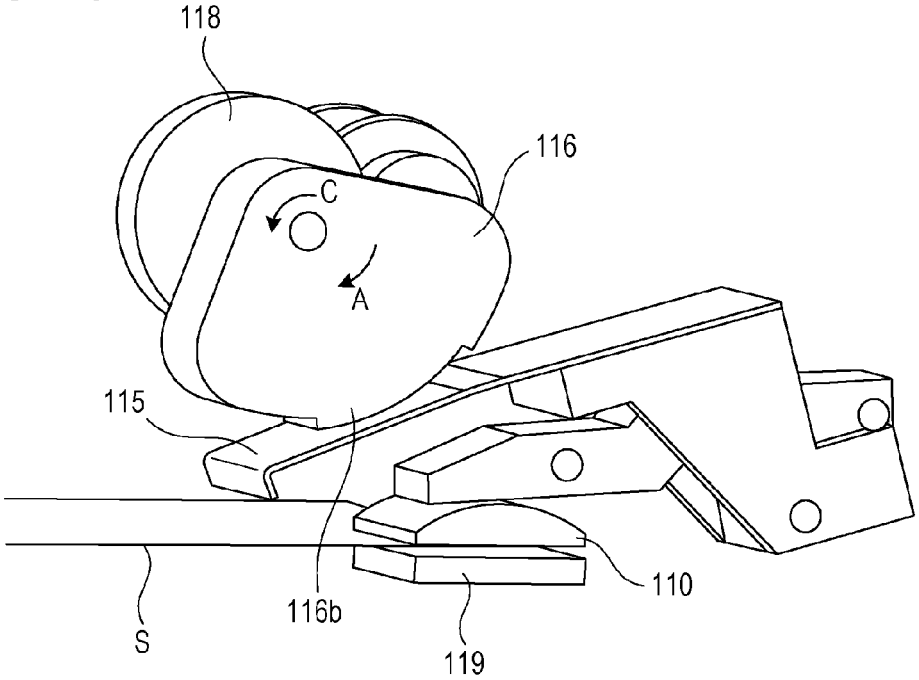

On the other hand, when a limit current is detected within the predetermined time period (YES in S702), the CPU 162 drives the stapleless binding motor 75 by using the limit current via the drive circuit 82 for a predetermined time period from a point in time of detection performed by the current limiting circuit 100 as illustrated in FIG. 9 (S705). The stapleless binding motor 75 is driven using the limit current for the predetermined time period, thereby causing the stapleless binding motor 75 to generate a predetermined driving torque for the predetermined time period. The upper teeth 97 and the lower teeth 98 press a sheet bundle SA at a predetermined pressing force by using a driving force (driving torque) generated by the stapleless binding motor 75. That is, because the mesh of the upper teeth 97 and the lower teeth 98 at a predetermined pressing force required for binding is retained for the predetermined time period with the sheet bundle SA interposed between the upper teeth 97 and the lower teeth 98, the stapleless binding process may be performed on the sheet bundle SA with certainty. In other words, a state in which a plurality of sheets are sandwiched between the upper teeth 97 and the lower teeth 98 at the predetermined pressing force is retained for the predetermined time period, and thus the stapleless binding process may be performed on the sheet bundle SA with certainty.

The predetermined time period serving as a retention time period of the mesh is determined in accordance with a damping characteristic of a sheet, and is measured by the timer Tm. This damping characteristic is determined by a physical property of the sheet, and conditions, such as temperature and humidity. For example, a damping force is increased as the rigidity of fibers of the sheet increases. In this case, because a time period taken to perform pressing is also increased, the retention time period has to be increased. The softness of the fibers is determined by using Young's modulus. In coated paper having a resin layer on a sheet surface in particular, because Young's modulus is high, the retention time period is increased.

Furthermore, because the time period taken to perform pressing is also increased as the thickness of the sheet increases, the retention time period is increased. The thickness of the sheet is determined by using a basis weight, and the retention time period is set to be long for a sheet whose basis weight is high. The softness of the fibers varies with environmental conditions, such as temperature and humidity. As humidity and temperature decrease, the moisture content of the sheet is reduced and the rigidity of the fibers is increased, and as humidity and temperature increase, the moisture content of the sheet is increased and the softness of the fibers is increased. For this reason, the time period taken to perform pressing is increased in a low-temperature and low-humidity environment, and thus the retention time period has to be increased. That is, this predetermined time period is determined in accordance with at least one of thickness, Young's modulus, and moisture content, or at least one of temperature and humidity.

Next, when the timer Tm determines that the retention time period of the mesh has elapsed, the CPU 162 drives and rotates the stapleless binding motor 75 reversely, that is, drives the stapleless binding motor 75 in a counterclockwise (CCW) direction (S706) and moves the upper teeth 97 in a direction away from the lower teeth 98 so as to separate the upper teeth 97 from the sheet bundle SA. Subsequently, when the stapleless binding reference sensor 76 turns ON (YES in S707), the stapleless binding motor 75 is stopped via the drive circuit 82 (S708), and the stapleless binding process is ended (S709).

As described above, in the embodiment, when the upper teeth 97 are moved by the cam 92 and a plurality of sheets are sandwiched between the upper teeth 97 and the lower teeth 98 at a predetermined pressing force, this state is retained for a predetermined time period. This enables a pressing force applied to any sheet bundle having a thickness within a predetermined range to be retained with certainty without any elastic member being provided, and enables the sheet bundle to be bound with certainty.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-106002, filed May 20, 2013, which is hereby incorporated by reference herein in its entirety.

What is claimed is:

1. A sheet processing apparatus comprising:

a pair of portions that sandwiches a plurality of sheets between the pair of portions to bind the plurality of sheets without a staple;

a motor that generates a driving torque corresponding to a value of a current flowing through the motor, the driving torque being applied to one portion of the pair of portions to sandwich the plurality of sheets by the pair of portions; and an adjustment unit that adjusts the value of the current flowing through the motor so that in a state in which the pair of portions sandwiches the plurality of sheets, a current of a predetermined value is flowed through the motor for a predetermined time period.

2. The sheet processing apparatus according to claim 1, wherein the motor is capable of normally rotating and reversely rotating, and wherein the motor normally rotates so as to move the one of the pair of portions in such a direction that the plurality of sheets are sandwiched between the pair of portions and then the motor reversely rotates so as to move the one of the pair of portions in the direction away from the another of the pair of portions.

3. The sheet processing apparatus according to claim 1, wherein the predetermined time period is determined in accordance with a physical property of a sheet.

4. The sheet processing apparatus according to claim 3, wherein the physical property of the sheet includes at least one of a thickness, a Young's modulus, and a moisture content.

5. The sheet processing apparatus according to claim 1, wherein the predetermined time period is determined in accordance with at least one of temperature and humidity.

6. The sheet processing apparatus according to claim 1, further comprising a cam configured to be rotated by the motor and to move one of the pair of portions.

7. The sheet processing apparatus according to claim 1, further comprising a detection unit that detects a value of a current flowing through the motor, wherein, if the plurality of sheets have been sandwiched by the pair of portions and then the detection unit detects that the value of the current flowing through the motor has reached the predetermined value, the adjustment unit makes an adjustment so that a current of the predetermined value is flowed through the motor for the predetermined time period.

8. The sheet processing apparatus according to claim 1, wherein one of the pair of portions includes a convex surface and another of the pair of portions includes a concave surface, the plurality of sheets are sandwiched between the convex surface and the concave surface.

9. The sheet processing apparatus according to claim 8, further comprising:

a detection unit that detects a value of a current flowing through the motor, wherein, when the plurality of sheets have been sandwiched between the convex surface and the concave surface and then the detection unit detects that the value of the current flowing through the motor has reached the predetermined value, the adjustment unit adjusts the current flowing through the motor so that a current of the predetermined value is flowed through the motor for the predetermined time period.

10. The sheet processing apparatus according to claim 1, wherein each of the pair of portions is a member having teeth.

11. A sheet processing apparatus comprising:

a binding unit that includes a convex portion and a concave portion, and sandwiches and binds a plurality of sheets by using the convex portion and the concave portion;

a cam that moves at least one of the convex portion and the concave portion with respect to another of the convex portion and the concave portion;

a motor capable of rotating the cam;

a power source that drives the motor;

an adjustment unit that adjusts a value of a current flowing through the motor from the power source in accordance with a magnitude of a driving torque to be generated by the motor so that the binding unit sandwiches the plurality of sheets;

a detection unit that detects a value of a current flowing through the motor; and if the plurality of sheets have been sandwiched between the convex portion and the concave portion by the cam moving the one of the convex portion and the concave portion and then the detection unit detects that the value of the current flowing through the motor has reached a predetermined value, a control unit that controls the adjustment unit so that a current of the predetermined value is flowed through the motor for a predetermined time period.

12. The sheet processing apparatus according to claim 11, wherein the control unit rotates the motor reversely so as to move the one of the convex portion and the concave portion in a direction away from the another of the convex portion and the concave portion after the predetermined time period has elapsed.

13. The sheet processing apparatus according to claim 11, wherein the predetermined time period is determined in accordance with a physical property of a sheet.

14. The sheet processing apparatus according to claim 13, wherein the physical property of the sheet includes at least one of a thickness, a Young's modulus, and a moisture content.

15. The sheet processing apparatus according to claim 11, wherein the predetermined time period is determined in accordance with at least one of temperature and humidity.

16. An image forming apparatus comprising:

an image forming unit configured to form an image; and a pair of portions that sandwiches a plurality of sheets having a image formed by the image forming unit between the pair of portions to bind the plurality of sheets without a staple;

a motor that generates a driving torque corresponding to an amount of a current flowing through the motor, the driving torque being applied to one portion of the pair of portions to sandwich the plurality of sheets by the pair of portions; and an adjustment unit that adjusts the value of the current flowing through the motor so that in a state in which the pair of portions sandwiches the plurality of sheets, a current of a predetermined value is flowed through the motor for a predetermined time period.

* * * * *